US006624096B2

(12) United States Patent
Thomas et al.

(10) Patent No.: US 6,624,096 B2
(45) Date of Patent: Sep. 23, 2003

(54) TEXTILE FABRIC FOR THE OUTER SHELL OF A FIREFIGHTERS'S GARMET

(75) Inventors: Charles A. Thomas, Charlotte, NC (US); Clifton A. Perry, Charlotte, NC (US); Richard O. Tucker, Oakboro, NC (US)

(73) Assignee: CNA Holdings, Inc., Summit, NJ (US)

( * ) Notice: Subject to any disclaimer, the term of this patent is extended or adjusted under 35 U.S.C. 154(b) by 55 days.

(21) Appl. No.: 09/933,301

(22) Filed: Aug. 20, 2001

(65) Prior Publication Data

US 2003/0040240 A1 Feb. 27, 2003

(51) Int. Cl.[7] ..... B27N 9/00; D03D 15/00

(52) U.S. Cl. ..... 442/181; 169/45; 169/46; 169/47; 169/48; 169/49; 169/50; 442/208; 442/209; 442/213; 442/215; 442/301; 442/302; 428/920; 428/921

(58) Field of Search ..... 169/45, 46, 47, 169/48, 49, 50; 442/208, 209, 213, 215, 301, 302; 428/926, 921

(56) References Cited

U.S. PATENT DOCUMENTS 4,865,906 A * 9/1989 Smith, Jr. ..... 428/224
5,095,549 A 3/1992 Aldridge
5,136,723 A 8/1992 Aldridge et al.
5,299,602 A 4/1994 Barbeau et al.
5,560,990 A * 10/1996 Ilg et al. ..... 428/362
5,628,065 A 5/1997 Austin
5,701,606 A 12/1997 Aldridge
5,928,971 A 7/1999 Ellis et al.
5,983,409 A 11/1999 Aldridge et al.
5,996,122 A 12/1999 Aldridge et al.
6,038,700 A 3/2000 Aldridge et al.
6,065,153 A 5/2000 Underwood et al.
6,192,520 B1 2/2001 Underwood et al.
2002/0034905 A1 * 3/2002 Truesdale, III ..... 442/197
2002/0124544 A1 * 9/2002 Land et al. ..... 57/5

* cited by examiner

*Primary Examiner*—Terrel Morris
*Assistant Examiner*—Alexis Wachtel
(74) *Attorney, Agent, or Firm*—Robert H. Hammer, III, P.C.

(57) ABSTRACT

The present invention is directed to a textile fabric. This fabric is particularly well suited for use as the outer shell fabric of a firefighter's garment. The fabric is a woven fabric of spun yarns and multi-filament yarns. The spun yarn includes a first staple being a polymer selected from the group consisting of PBI or PBO or melamine formaldehyde, and a second staple being an aramid polymer. The multi-filament yarn includes an aramid filament.

15 Claims, 1 Drawing Sheet

TEXTILE FABRIC FOR THE OUTER SHELL OF A FIREFIGHTERS'S GARMET

FIELD OF THE INVENTION

The present invention is directed to a textile fabric for use as the outer shell fabric of a firefighter's garment.

BACKGROUND OF THE INVENTION

The outer shell fabric of a firefighter's garment must be flame, heat, abrasion, tear, and moisture resistant, durable, and lightweight. This outer shell fabric provides the first layer of protection for the firefighter.

U.S. Pat. Nos. 5,095,549; 5,136,723; 5,701,606; 5,983,409; 5,996,122; and 6,038,700 disclose, among other things, firefighter's garments having an outer shell fabric made of PBI/aramid fibers.

U.S. Pat. No. 5,299,602 discloses a woven, outer shell fabric made for firefighter's garments where the warp yarns are multi-filament aramid yarns and the weft yarns are either multi-filament or spun aramid yarns.

U.S. Pat. No. 5,628,065 discloses a firefighter's hood of a knit fabric formed of a blend of PBI and aramid fibers.

U.S. Pat. Nos. 6,065,153 and 6,192,520 disclose a woven outer shell fabric for a firefighter's garments. This fabric has a plain, twill or rip stop weave and the yarns are a mixture of PBI and aramid fibers. The fabric has a weight ranging from 5.5 to 8 OSY, preferably, 7.5 OSY.

One popular outer shell fabric is a woven fabric of spun yarns consisting of PBI and aramid staple. This fabric is known in the market as 'PBI GOLD®.' In the U.S., this fabric generally is made in the following forms: 1) a 7.5 OSY rip stop weave made from a 16/2 c.c. spun yarns consisting of 40% by weight PBI and 60% by weight of a para-aramid; or 2) a nominal 7.0 OSY (actual 7.3 to 7.4 OSY) rip stop weave made from a 21/2 c.c. spun yarns consisting of 40% PBI and 60% of the para-aramid. Internationally, this fabric is in the form of a 6.0 to 6.5 OSY rip stop weave 24–25/2 c.c. spun yarns of 40% PBI and 60% para-aramid, or a twill weave made from 35/2 c.c. spun yarns of 40% PBI and 60% para-aramid.

Another fabric used as an outer shell fabric is marketed under the trade name 'Millenia' from Southern Mills, Inc. of Union City, Ga. The Millenia fabric is made with a spun yarn consisting of 40% PBO and 60% para-aramid staple.

While 'PBI GOLD®' has proven to be an excellent outer shell fabric, there is still a need to improve these fabrics. There is a desire to have lighter weight fabrics that have better tear and abrasion resistance.

SUMMARY OF THE INVENTION

The present invention is directed to a textile fabric. This fabric is preferably used as the outer shell fabric of a firefighter's garment. The fabric is a woven fabric of spun yarns and multi-filament yarns. The spun yarn includes a first staple being a polymer selected from the group consisting of PBI or PBO or melamine formaldehyde, and a second staple being an aramid polymer. The multi-filament yarn includes an aramid filament.

DESCRIPTION OF THE DRAWINGS

For the purpose of illustrating the invention, there is shown in the drawings a form of the invention; it being understood, however, that this invention is not limited to the precise arrangements and instrumentality shown.

DESCRIPTION OF THE INVENTION

Figure 1:
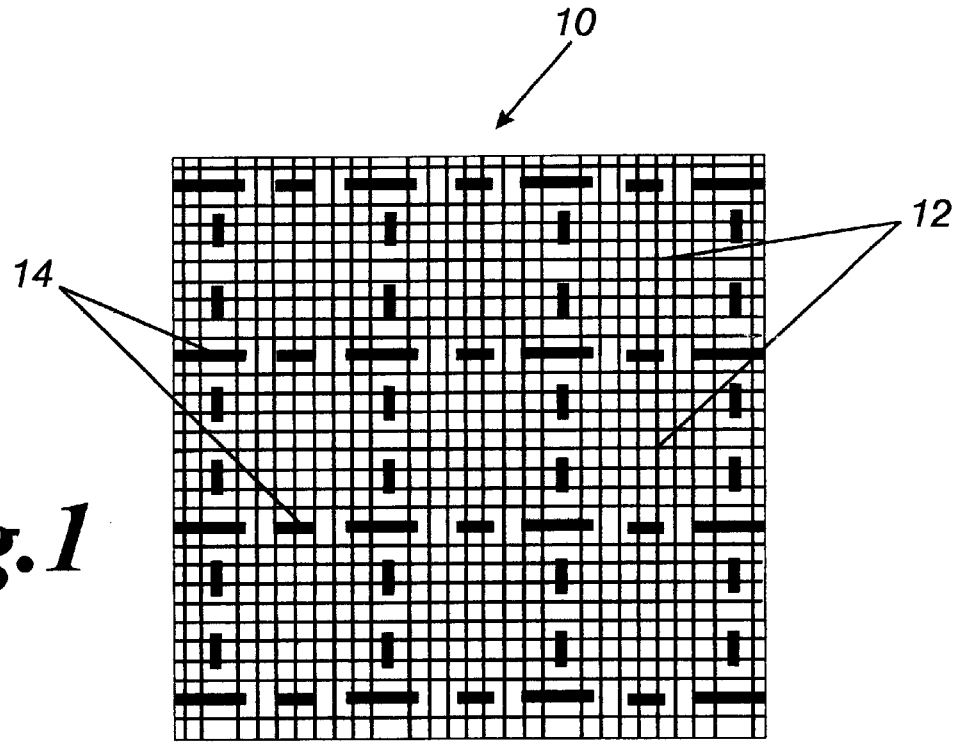
FIG. 1 is a plan view of the textile fabric made according to the present invention.
Figure 2:
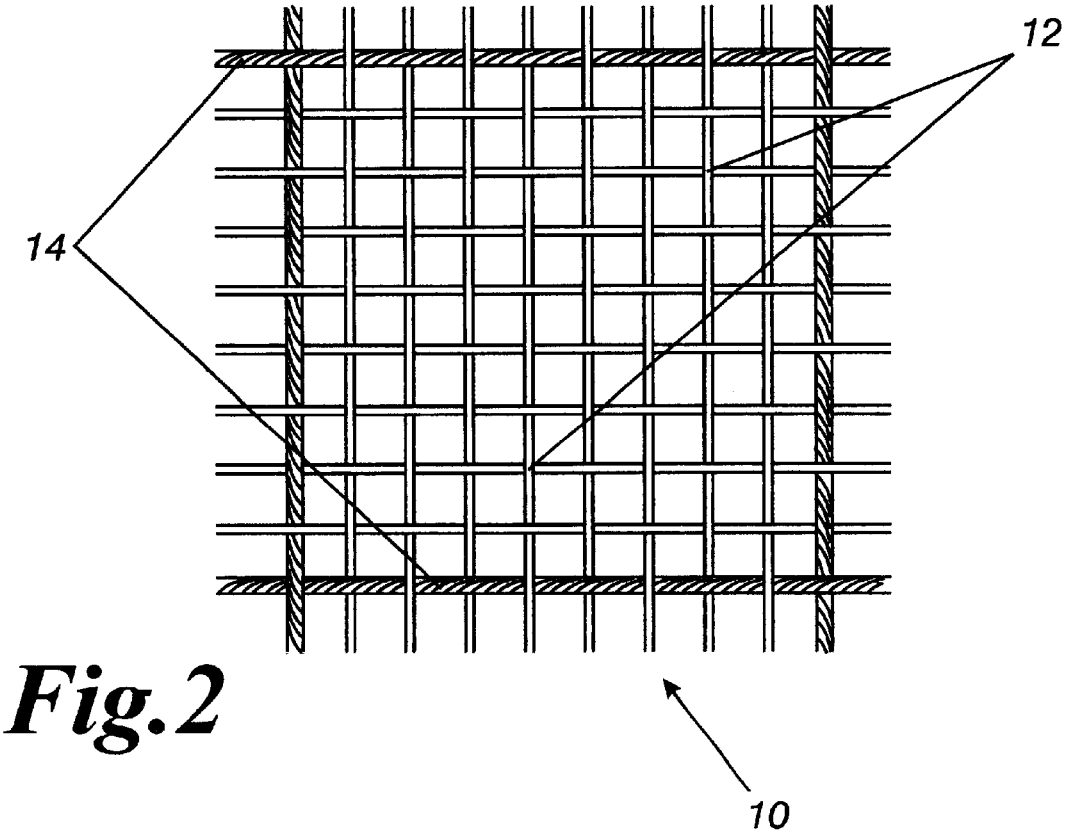
FIG. 2 is a magnified plan view of the textile fabric made according to the present invention.

Referring to the drawings wherein like numerals indicate like elements there is shown in FIG. 1 an illustration of the textile fabric 10 made according to the present invention. Preferably, the fabric 10 has a gold color with a 'checkered' pattern created by black multi-filament yarns 14. The fabric 10 is preferably woven with spun yarns 12 and multi-filament yarns 14. The weaves are selected from the group consisting of plain, twill, rip stop, and oxford. The fabric weight may range from 6 to 8 OSY, preferably, 7 OSY. The weight ratio of spun yarns to multi-filament yarns should range from 85:15 to 92:8, preferably, 90:10. The multi-filament yarn may be inserted among the spun yarns, in both the warp and weft, at an insertion ratio of 1:5 to 1:20, preferably, 1:9. Preferably, the fabric is treated with a water/moisture resistant finish, as is well known.

The spun yarns 12 are a blend of a first staple and a second staple. The first staple is fiber made from a polymer selected from the group of PBI, PBO, a melamine formaldehyde, or combinations thereof. The second staple is a fiber made from an aramid or blends of aramids. Exemplary spun yarns include, but are not limited to, blends of PBI and aramid staple, PBO and aramid staple, melamine formaldehyde and aramid staples and PBI, PBO, melamine formaldehyde, and aramid staple. The spun yarns preferably comprise 45% by weight of the first staple, and 55% by weight of the aramid staple. The spun yarns may range in size from 32/2 to 16/2 c.c., preferably, 24/2 c.c.

PBI staple fibers are commercially available from Celanese Acetate LLC of Charlotte, N.C. PBO staple fibers are commercially available under the trade name of ZYLON® from Toyobo Co., Ltd. of Osaka, Japan. Melamine formaldehyde fibers are commercially available under the trade name of BASOFIL® from BASF Corporation of Mount Olive, N.J.

The aramid staple fibers may be either a meta-aramid or a para-aramid; the para-aramid is preferred. Such aramid fibers are commercially available under the trade name of TWARON®, CONEX®, and TECHNORA® from Teijin Co. of Osaka, Japan; or NOMEX® or KELVAR® from DuPont of Wilmington, Del.; or P84 from Lenzing AG of Lenzing, Austria; or KERMEL® from Rhodia Inc. of Cranbury, N.J.

The multi-filament yarn is made from aramid filament. Aramid may be either meta-aramid or para-aramid, the para-aramid is preferred. Such aramid fibers are commercially available under the trade name of TECHNORA®, TWARON®, and CONEX® from Teijin Co. of Osaka, Japan, or NOMEX® or KELVAR® from DuPont of Wilmington, Del., or P84 from Lenzing AG of Lenzing, Austria or KERMEL® from Rhodia Inc. of Cranbury, N.J. The multi-filament yarn ranges in size from 200 to 1500 denier, preferably, 400 denier. The multi-filament yarn may be a flat yarn, a twisted yarn, or a stretch broken yarn.

The instant invention has superior tear and abrasion resistance, at a lower weight, over the PBI GOLD® fabric. The results are set forth in Table 1.

Fabric A is 6.0 OSY fabric; spun yarn is 27/2 c.c. with 45 percent weight PBI and 55 percent Technora® staple; multi-filament is a flat yarn inserted every $10^{th}$ yarn in the warp and weft.

Fabric B is 6.9 OSY fabric; spun yarn is 24/2 c.c. with 45 percent weight PBI and 55 percent Twaron® microdenier staple; multi-filament is a twisted yarn inserted every $9^{th}$ yarn in the warp and weft.

TABLE 1

| Performance Characteristic | Test Method | PBI Gold | Invention A | Invention B |
|---|---|---|---|---|
| Weight (OSY) | | 7.5 | 6.0 | 6.8–7.0 |
| Trap Tear (lbs.) | ASTM D5733 (Trapezoidal Method) | 40 × 35 | 75 × 75 | 63 × 63 |
| Tabor abrasion | ASTM D-3884 (500 g wt. With H18 abrasion wheel) | 225 | 180 | 293 |
| Thermal Protective Performance, TPP (Composite) | NFPA 1971 (2000 Edition Section 6.10) | 40 | 40 | 40 |
| Trap Tear after UV | AATCC 16 E (Standard Method for Xenon arc exposure at 1.1 rad) | | | |
| 60 hr | | 28.4 × 18.7 | 44.6 × 38.5 | |
| 180 hr | | 17.8 × 12.3 | 25.7 × 18.9 | |
| 300 hr | | 15.2 × 10.6 | 21.2 × 16.1 | |
| Trap Tear after Sunlight | ASTM D5733 (Trapezoid Method) | | | |
| 1 week | | 30.8 × 20.8 | 64.9 × 62.7 | |
| 2 week | | 24.3 × 17.0 | 45.5 × 40.1 | |
| 3 week | | 20.0 × 14.6 | 39.0 × 34.2 | |
| 4 week | | 18.8 × 13.1 | 34.0 × 33.9 | |
| 5 week | | 16.6 × 13.5 | 29.7 × 30.1 | |
| 6 week | | 14.8 × 10.5 | 26.6 × 23.6 | |

The present invention made be embodied in other forms without departing from the spirit and the central attributes thereof and, accordingly, reference should be made to the appended claims, rather than to the foregoing specification, as indicated the scope of the invention.

What is claimed is:

1. A textile fabric comprising: a woven material of spun yarns including first staple being a polymer selected from the group consisting of PBI, PBO, or melamine formaldehyde, and a second staple of an aramid polymer; and multi-filament yarns including an aramid filament, wherein the weight ratio of said spun yarn to said multi-filament yarn ranges from 85:15 to 92:8.

2. The fabric of claim 1 wherein the weight ratio is 90:10.

3. The fabric of claim 1 wherein the woven fabric weight ranging from 6 to 8 OSY.

4. The fabric of claim 1 wherein the woven fabric has a weave selected from the group consisting plain, twill, rip stop, or oxford.

5. The fabric of claim 1 wherein the spun yarn ranges from 32/2 to 16/2 c.c.

6. The fabric of claim 1 wherein the multi-filament yarn ranges from 200 to 1500 denier.

7. The fabric of claim 1 wherein the multi-filament yarn being inserted among the spun yarn at a ratio of 1:5 to 1:20.

8. A textile fabric comprising: a woven material of spun yarn, said spun yarn being a blend of staple, a first staple being made of a polymer selected from the group consisting of PBI, PBO, melamine formaldehyde, or combinations thereof and a second staple being made of an aramid, and a multi-filament yarn including aramid filaments, said multi-filament yarns being inserted into said woven material, in both the warp and the weft, at a multi-filament yarn to spun yarn ratio of 1:5 to 1:20.

9. The fabric of claim 8 wherein said spun yarn being a blend of PBI and aramid staple.

10. The fabric of claim 8 wherein said spun yarn being a blend of PBO and aramid staple.

11. The fabric of claim 8 wherein said spun yarn being a blend of PBI, PBO, and aramid staple.

12. The fabric of claim 8 wherein the spun yarn ranges from 32/2 to 16/2 c.c.

13. The fabric of claim 8 wherein the multi-filament yarn ranges from 200 to 1500 denier.

14. The fabric of claim 8 wherein the woven fabric weight ranging from 6 to 8 OSY.

15. The fabric of claim 14 wherein the woven fabric has a weave selected from the group consisting plain, twill, rip stop, or oxford.

* * * * *

US006624096C1

(12) EX PARTE REEXAMINATION CERTIFICATE (7912th)

United States Patent

Thomas et al.

(10) Number: US 6,624,096 C1

(45) Certificate Issued: Dec. 7, 2010

(54) TEXTILE FABRIC FOR THE OUTER SHELL OF A FIREFIGHTERS'S GARMENT

(75) Inventors: Charles A. Thomas, Charlotte, NC (US); Clifton A. Perry, Charlotte, NC (US); Richard O. Tucker, Oakboro, NC (US)

(73) Assignee: PBI Performance Products, Inc., Charlotte, NC (US)

Reexamination Request:
No. 90/008,132, Jul. 25, 2006

Reexamination Certificate for:

| | |
|---|---|
| Patent No.: | **6,624,096** |
| Issued: | **Sep. 23, 2003** |
| Appl. No.: | **09/933,301** |
| Filed: | **Aug. 20, 2001** |

(51) Int. Cl.

| | |
|---|---|
| ***A41D 31/00*** | (2006.01) |
| ***A62B 17/00*** | (2006.01) |
| ***D03D 15/12*** | (2006.01) |

(52) U.S. Cl. ..... 442/181; 169/45; 169/46; 169/47; 169/48; 169/49; 169/50; 442/208; 442/209; 442/213; 442/215; 442/301; 442/302; 428/920; 428/921

(58) Field of Classification Search ..... None
See application file for complete search history.

(56) References Cited

U.S. PATENT DOCUMENTS

| | | | |
|---|---|---|---|
| 4,958,485 | A | 9/1990 | Montgomery et al. |
| 5,299,602 | A | 4/1994 | Barbeau |
| 5,447,787 | A | 9/1995 | Shaffer |
| 5,482,763 | A | 1/1996 | Shaffer |
| 5,624,738 | A | 4/1997 | Barbeau et al. |
| 6,562,741 | B1 | 5/2003 | Lilani |
| 6,624,096 | B2 | 9/2003 | Thomas et al. |
| 6,974,785 | B1 | 12/2005 | Barbeau |

OTHER PUBLICATIONS

Wellington Sears Handbook of Industrial Textiles—1963 Cover, Copyright pages, pp. 154 to 159.

Dictionary of Fiber & Textile Technology, Kosa, Charlotte, NC (1999) pp. 42, 44, 184.

NFPA 1971 (2007 Edition), NFPA, 1 Battery Park, Quincy, MA, pp. 1971–1933 & 1971–1956.

ASTM D1424–96—Standard Test Method for Tearing Strength of Fabrics by Falling Pendulum Type (Elmendorf) Apparatus, ASTM, 100 Barr Harbor Drive, West Conshohocken, PA, Aug. 1996.

ASTM D5587–05—Standard Test Method for Tearing Strength of Fabrics by Trapezoid Procedure, ASTM, 100 Barr Harbor Drive, West Conshohocken, PA, Apr. 2005.

"Abrade; abrasion," The Random House College Dictionary Revised Edition, The Random House, Inc. (New York), (p. 4,5), (1980).

"Abrasion Resistance," Dictionary of Fiber & Textile Technology, KoSa (Charlotte, NC), (p. 1), (1999).

"Tear," The Random House College Dictionary Revised Edition, Random House, Inc. (New York), (p. 1348), (1980).

"Tear Strength," Dictionary of Fiber & Textile Technology, KoSa (Charlotte, NC), (p. 193), (1999).

*Primary Examiner*—Sharon Turner

(57) ABSTRACT

The present invention is directed to a textile fabric. This fabric is particularly well suited for use as the outer shell fabric of a firefighter's garment. The fabric is woven fabric of spun yarns and multi-filament yarns. The spun yarn includes a first staple being a polymer selected from the group consisting of PBI or PBO or melamine formaldehyde, and a second staple being an aramid polymer. The multifilament yarn includes an aramid filament.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-15 are cancelled.
New claims 16-30 are cancelled.

* * * * *